United States Patent [19]

Kovacs

[11] 4,187,906

[45] Feb. 12, 1980

[54] WELL BORE APPARATUS WITH ANNULUS PRESSURE RELEASABLE TUBING SEAL UNIT

[75] Inventor: Jozsef P. Kovacs, Lafayette, La.

[73] Assignee: Baker International Corporation, Orange, Calif.

[21] Appl. No.: 903,787

[22] Filed: May 8, 1978

[51] Int. Cl.[2] ..... E21B 23/04; E21B 17/02

[52] U.S. Cl. ..... 166/120; 166/125; 285/18

[58] Field of Search ..... 166/120, 123, 125, 181, 166/182; 285/208, 18, 306

[56] References Cited

U.S. PATENT DOCUMENTS

| | | | |
|---|---|---|---|
| 2,409,811 | 10/1946 | Taylor, Jr. et al. | 166/125 |
| 2,978,032 | 4/1961 | Hanna | 166/125 |
| 3,008,523 | 11/1961 | Clark, Jr. et al. | 166/120 |
| 3,035,642 | 5/1962 | Page | 166/72 |
| 3,037,797 | 6/1962 | Brown | 166/181 |
| 3,870,104 | 3/1975 | Mott | 166/208 |
| 3,920,075 | 11/1975 | Braddick et al. | 166/208 |
| 3,934,652 | 1/1976 | Cochran | 166/208 |
| 4,008,759 | 2/1977 | Blackwell | 166/125 |

*Primary Examiner*—James A. Leppink
*Attorney, Agent, or Firm*—Subkow and Kriegel

[57] ABSTRACT

Well bore apparatus is installed in a well casing on a tubular string having a packer anchored in and forming a seal within the casing. In the tubing string above the packer is a safety valve structure held open by the pressure of fluid supplied through control fluid tubing extending to the top of the well between the exterior of the tubing string and the casing. A long tubing seal structure has a lock releasable by the pressure of fluid supplied through the annulus, or alternatively by rotation of the tubing in an emergency.

The tubing seal structure is released to enable the tubing string to move freely in either direction, in response to pressure and/or temperature changes, whereby tension and compression reversals are eliminated. The tubing string above the sealing receptacle can be pulled from above the packer and other downhole structures. The hydraulic release is operable by annulus pressure to release the receptacle for longitudinal movement relative to a long sealing slick joint after testing of the packer.

13 Claims, 7 Drawing Figures

WELL BORE APPARATUS WITH ANNULUS PRESSURE RELEASABLE TUBING SEAL UNIT

In the completion of certain wells, such as oil or gas wells drilled into the earth and cased to or through the productive formation or formations, it is one practice to set a casing packer above the productive formation and to provide a tubing string between the packer and the production tree at the top of the well to conduct the production fluid from the well. Reversals of loading of the tubing joints can cause loosening of the joints and potential damage and leakage. To avoid such reversals tubing seal connectors have evolved including a sealing receptacle and a long sealing tube or "slick joint," released by manipulation of the tubing string to allow the tubing to be spaced out and slidably and sealingly engaged with the sealing or slick joint, before connecting the tubing to the production tree and bringing the well in by conventional methods, such as displacement of fluid from the tubing or swabbing the well in.

Typically, a permanent packer may be set in the casing by a wireline setting tool, and the tubing is run into the well and latched into the packer by an anchor and sealing structure below a long tubing seal which is mechanically locked together. The long tubing seal can be released to allow spacing the tubing out by manipulation of the tubing string before connection of the tubing string with the production tree. Such operations involving manipulation of the tubing string can cause problems, say, for example, when an automatic safety valve structure is provided in the tubing above the long tubing seal and is controlled by fluid supplied through control tubings extending along the outside of the tubing string within the casing. Tubing manipulation can cause damage to the relatively small control tubings, particularly if the well bore is crooked or deviated at an angle causing engagement of the control tubings with the casing.

The disclosure of U.S. patent application Ser. No. 936,851, filed Aug. 25, 1978, of Oden, et al., for "Well Bore Apparatus With Hydraulically Releasable Tubing Seal Unit," relates to improvements in such well completion apparatus eliminating the necessity for tubing manipulation to release a long tubing seal structure.

In accomplishing the foregoing, a long tubing seal receptacle structure is installed in the tubing string and has a releasable connection between a long sealing receptacle and a long slick joint or inner sealing tube. The structure includes a fluid pressure operated release mechanism between the housing or receptacle and the sealing, inner tube or slick joint. In the form illustrated in that application, the release mechanism responds to the pressure of fluid in the tubing, but in some cases it is disadvantageous for the release to be responsive to tubing pressure.

In accordance with that application, latch elements carried by an outer receptacle or tubular sealing body are biased outwardly from a groove in the long sealing tube or slick joint, but are initially held in locking positions in the groove by a piston sleeve adapted to be shifted by fluid pressure supplied through the tubing, to a position releasing the latch elements from the groove, so that the outer housing cam move upwardly with the upwardly extended tubing string. No rotation of the tubing string is required to accomplish the release.

The packer is run in on the tubing string and can be hydraulically set and anchored before release of the sealing connector by utilizing a shearable ball seat or other device to blank off the tubing below the packer to cause the packer to be set, before the sealing connector is released. Such apparatus must be adjusted so that the tubing pressure sensitive release is actuated after the packer is set. The packer can be tested by pressurizing the annulus above the packer, but the temporary ball seat is opened to allow downward flow in the tubing, so that the packer cannot be tested by pressuring the tubing until after release of the sealing connector. Thus, if the packer leaks when pressured from below, roundtripping of the tubing is required.

The present invention obviates the problems of mechanical and tubing pressure released long sealing connectors by providing a sealing connector which is releasable by fluid pressure applied to the annulus above the packer after it has been set and pressure tested through the tubing.

In accomplishing the foregoing, an outer housing or receptacle is telescopically disposed over an inner sealing or slick joint and is locked thereon by a releasable latch responsive to annulus pressure applicable to a latch releasing piston which is initially held in a position, as by shearable means, preventing release of the latch.

The latch is an inherently contractible ring member carried on the inner member and initially held expanded into locking engagement in an internal groove in the outer member by portions of the latch releasing piston, until the piston is shifted by the application thereto of sufficient annulus pressure to overcome the holding effect of shear screws engaged between the piston and the inner member.

Retainer means are provided to prevent return movement of the piston after the latch has been released.

If for some reason, annulus fluid pressure cannot effect release of the latch, or in an emergency, the latch releasing piston can be mechanically shifted by rotation of the tubing to effect release of the latch.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings:

FIGS. 1*a* and 1*b*, together, constitute a view diagrammatically illustrating well bore apparatus with the hydraulically releasable tubing seal unit in accordance with the invention installed in a well casing, FIG. 1*b* being a downward continuation of FIG. 1*a*;

Figure 1A:
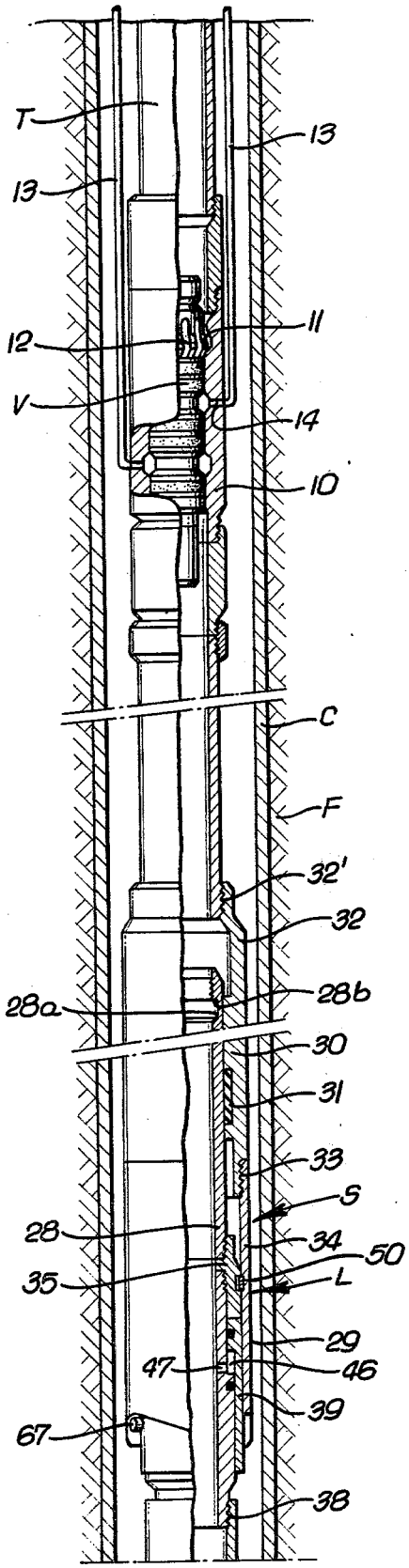
Figure 1B:
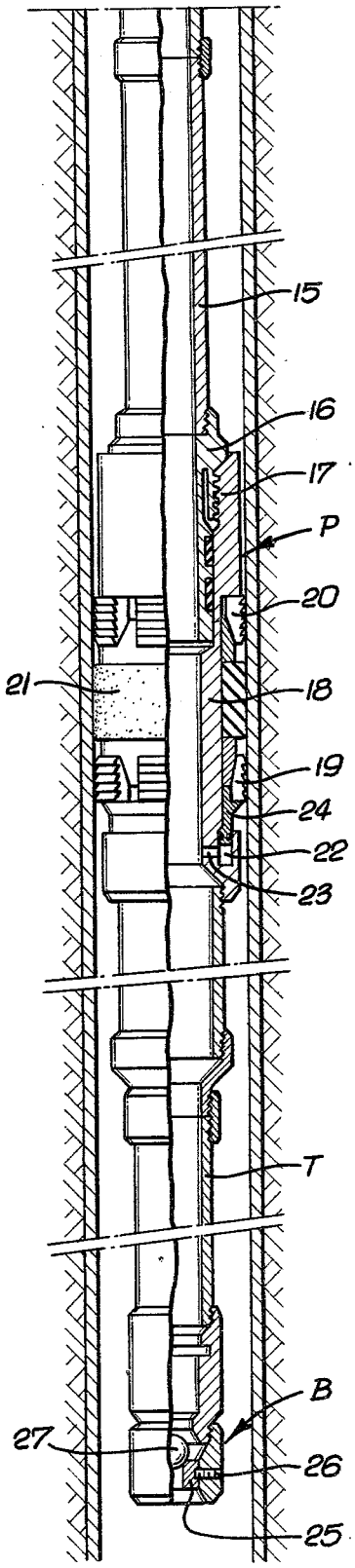

As seen in the drawings, referring first to FIG. 1*a* and FIG. 1*b*, well bore apparatus in accordance with the invention is shown as installed in a well casing C extending downwardly in a well bore drilled into or through earth formation F. The well bore apparatus includes a length of running tubing T adapted to contain the various tubular components to be described hereinafter, and to extend to the top of the well bore, where it can be connected with the usual production well head. Included in the tubular structure beneath the tubing T is a tubular seating nipple or body 10 providing a landing seat 11 in which a wireline retrievable, automatic shutoff or safety valve structure V is installed and retained in place by latch means 12. The valve V is of the type adapted to be maintained in an open condition by the application of control fluid pressure through dual control tubing strings 13, which extend from the seating nipple 10 to the top of the well in the annular space between the tubing T and the casing C. These tubings communicate with the automatic safety or shutoff valve V via passage means 14 in the seating nipple, whereby the automatic shutoff valve can be maintained in an open condition, permitting the flow of production fluid upwardly through the well bore apparatus, to the top of the well. However, when the control fluid pressure in the tubing 13 is released, the automatic shutoff valve closes, to shut the well in. Such valves may be either of the wireline retrievable type as generally illustrated herein, or may be of the type incorporated within the tubing structure. An example of such a valve structure is illustrated in U.S. Pat. No. 3,971,438, granted July 27, 1976, in the name of Talmadge L. Crowe, for "Wireline Safety Valve with Split Ball".

The control tubing string or strings 13, being external of the upwardly extended tubing string T, pose difficulties in operations involving the mechanical setting of packers or releasing of sealing assemblies within the tubular structure below the safety valve seating nipple, particularly in the case of very crooked or deviated bore holes, wherein rotative manipulation of the tubing string can cause damage to the control tubing 13.

Accordingly, within the tubular structure below the valve seating nipple 10 is a long tubing seal assembly S, adapted, as will be later described, to be released in response to applied fluid pressure, without manipulation of the tubing string T.

In the tubular structure below the tubing seal S, at some desired downwardly spaced location determined by the length of spacer tubing 15 which extends downwardly from the sealing receptacle, is a well bore packer assembly P of a known type. The illustrative packer is connected to the tubing string by a releasable anchor and tubing sealing nipple assembly 16, also of a known type, by means of threaded latch members 17 engaged within a companion bore of an elongated packer body or inner tubular mandrel 18. The packer assembly P includes normally retracted, downwardly holding lower slip elements 19 expansible outwardly into anchoring engagement with the casing, as well as normally retracted upwardly holding slips 20 expansible outwardly into gripping engagement with the casing C. Between the slip elements 19 and 20 is a resiliently deformable packing structure 21, of elastomeric material adapted to be deformed and resiliently expanded into tight sealing engagement within the well casing C to separate the annular space below the packing structure from the casing above the packing structure. The illustrative packer is adapted to be set by the pressure of fluid applied through the tubing string T to an annular piston chamber 22 within the packer body structure, fluid entering the piston chamber 22 via suitable radial passageways 23, and acting on an annular piston 24, whereby the respective casing engaging slip elements 20 and 19 are set in anchoring engagement with the well casing and the resilient packing 21 is deformed into sealing engagement with the casing. A specific example of such a packing structure is the model "SAB" retainer production packer of Baker Packers, Houston, Tex. Another example of a packer useful in such an installation is disclosed in the pending application of Talmadge L. Crowe for "Fluid Pressure Set and Released Well Packer Apparatus" Ser. No. 907,121, filed May 18, 1978 which is capable of being set and anchored in a well casing hydraulically, without tubing manipulation, as well as being released hydraulically without tubing manipulation.

Below the packer structure P the tubular assembly may include a suitable length of the tubing string T extending downwardly into the well bore and providing means B enabling pressurization of the tubing string for the purposes of effecting the setting of the packer P. This means B, may be one of a number of devices which, as is well known, provide a seat 25 disposed within the flow passage through the tubular structure, and initially retained in place by suitable shearable members 26. A ball or other closure device 27, is adapted to be dropped through the tubing string from the top of the well, and will seat upon the seating element 25. As will be later described, the pressure acting across the ball 27 and seat 25 acts to shear the screws 26 after setting the packer P in the tubular structure above the ball seat 25.

The releasable tubing seal unit S will be seen to include an elongated internal sealing mandrel or slick joint 28 telescopically extending into an outer tubular body 29 having an upwardly extended elongated sealing section 30, provided internally, at a suitable number of longitudinally spaced locations with circumferentially extended packing means or units 31 which slidably and sealingly engage the cylindrical slick joint 28. Latch means generally denoted at L initially interconnect the inner mandrel or slick joint 28 with the outer body structure 29, retaining them against telescopic movement. However, at the desired time, following the performance of various operations to be hereinafter described, the latch means L are releasable by fluid pressure to allow telescopic upward extension of the outer housing structure 29 with respect to the inner mandrel or slick joint 28.

Figure 2:
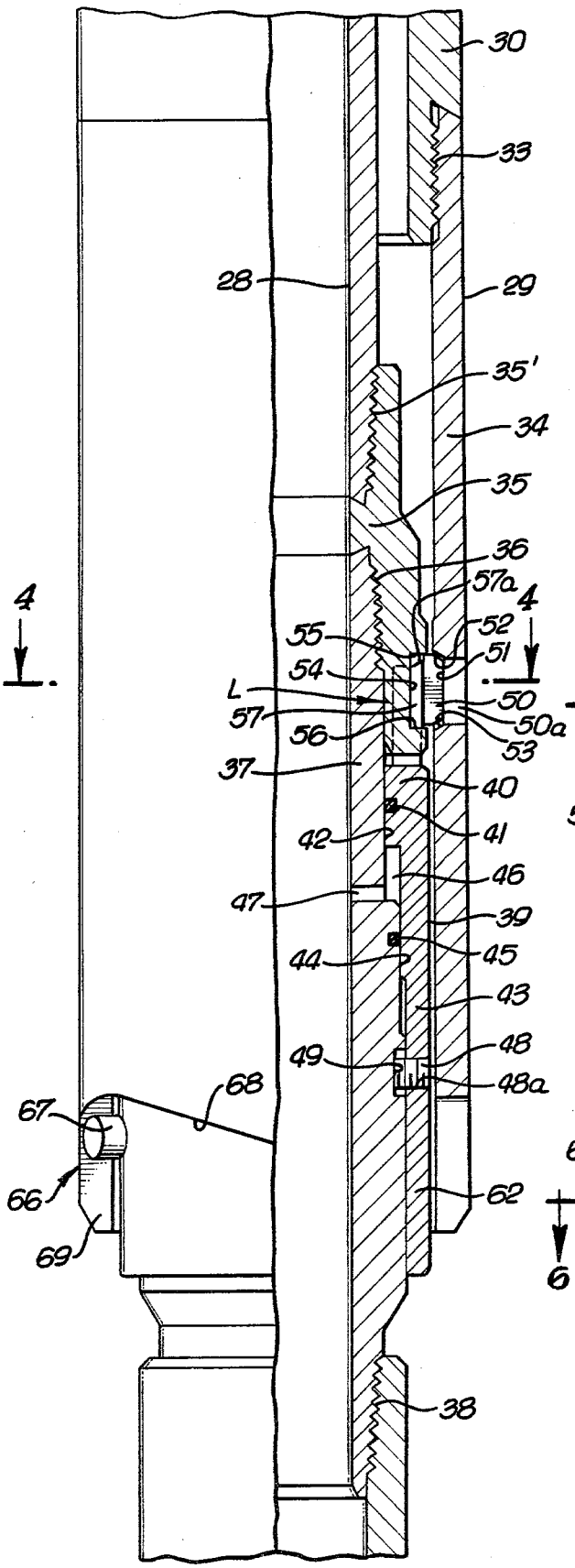
FIG. 2 is a partial elevation and partial section, on an enlarged scale, illustrating the hydraulically releasable latch mechanism in a latched condition.
Figure 4:
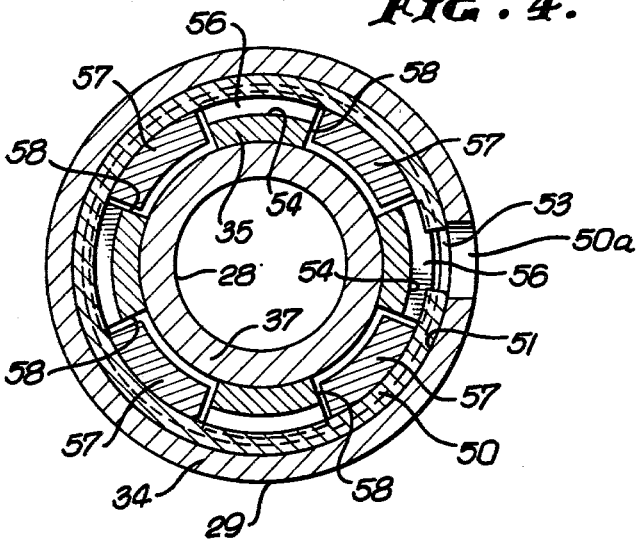
FIG. 4 is a transverse section as taken on the line 4—4 of FIG. 2.
Figure 5:
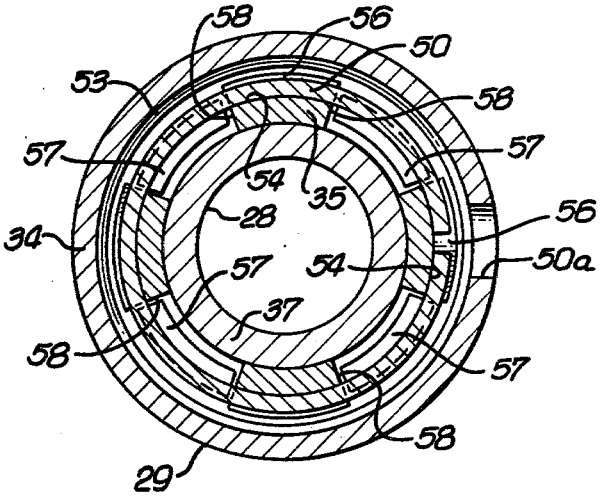
FIG. 5 is a transverse section as taken on the line 5—5 of FIG. 3; and, FIG. 6 is a transverse section as taken on the line 6—6 of FIG. 3.
Figure 6:
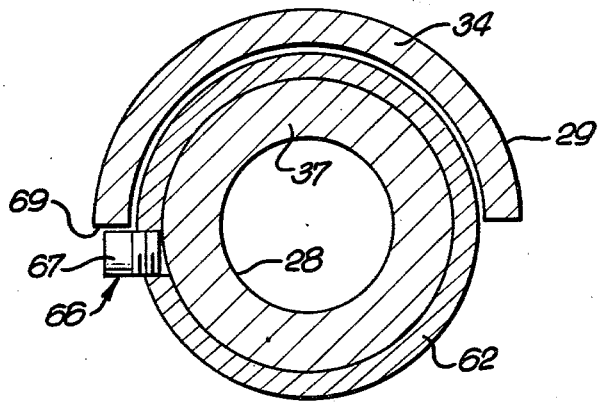

Referring to FIGS. 2 and 4, the releasable latch means L is shown in the normally latched condition, preventing telescopic movement between the mandrel 28 and the outer body structure 29, so that the tubular structure below the releasable connector is adapted to be run into the well bore to the desired location. The upper body structure includes a connector body 32 of tubular construction having a threaded connection 32' with a section of the tubing string T thereabove.

Connected to the lower end of the outer sealing body 30, by a threaded joint 33 is a downwardly extended latch housing 34 of tubular form engageable by the latch means L to normally prevent relative longitudinal movement between the slick joint 28 and the sealing housing 30. At the lower end of the slick joint or inner member 28 is a connector 35, having a threaded connection 35' with the slick joint 28 and a threaded connection 36 with a downwardly extending latch sub 37 of tubular construction. At its lower end, the sub 37 is threadedly connected at 38 to the downwardly extending tubing or to the packer body, depending upon the installation.

Disposed between the latch housing 34 and the latch sub 37 is an annular differential area piston 39 having an upper head 40. The piston head 40 has internal side ring or O-ring sealing means 41 slidably and sealingly engaged with a reduced external cylindrical wall 42 of the sub 37. A skirt 43 of the piston has sliding, sealing engagement with a larger diameter cylindrical section 44 of the sub 37. Side or O-ring seals 45 engage within the skirt 43. Between the head 40 and the larger sub section 44 is an annular chamber 46 which communicates through ports 47 with the interior of the sub 37. Means are provided for releasably holding the piston 39 in the upper position of FIG. 2. In the form shown, the piston skirt has shear screws 48 engaged in the piston skirt and extending into a groove 49 in the sub 37. These screws 48 can be sheared when sufficient pressure is applied to the piston head 40 over the differential area between seals 41 and 45 in the annular space externally of the tubing. Any tubing fluid in the internal chamber 46 is displaced through the ports 47.

With the latch piston 39 in the upper position of FIG. 2, the connector housing 34 is latched to the connector sub 37 by a circumferentially extended spring latch or C-ring 50. This latch 50 is held circumferentially expanded, as seen in FIGS. 2 and 4, so as to project into an annular groove 51 within the connector housing 34, having downwardly and upwardly facing shoulders 52 and 53 engageable by the expanded ring. The ring is disposed in an annular groove 54 in the connector 35, between downwardly and upwardly facing shoulders 55 and 56, so as to be partially expanded from the groove 54 and engaged between the connector and housing shoulders, thereby locking the connector against telescopic movement.

In order to hold the lock ring 50 in the expanded position of FIG. 2, the piston head 40 has upwardly projecting, circumferentially spaced lugs 57 adapted to extend into circumferentially spaced slots 58 in the lower end of the connector 35 to engage within the split lock ring 50.

On assembly, the lock ring 50 can be circumferentially expanded by a tool (not shown) insertable through a lateral access opening **50*a* in the connector housing 34, between the ends of the split or C-ring to force the ends angularly apart and expand the ring. The piston 39, can then be moved into position on the connector sub 37, to dispose the lugs 57 in the notches 58. Installation of the shear screw or screws 48, through openings 48*a*** in the piston holds the piston in place.

Figure 3:
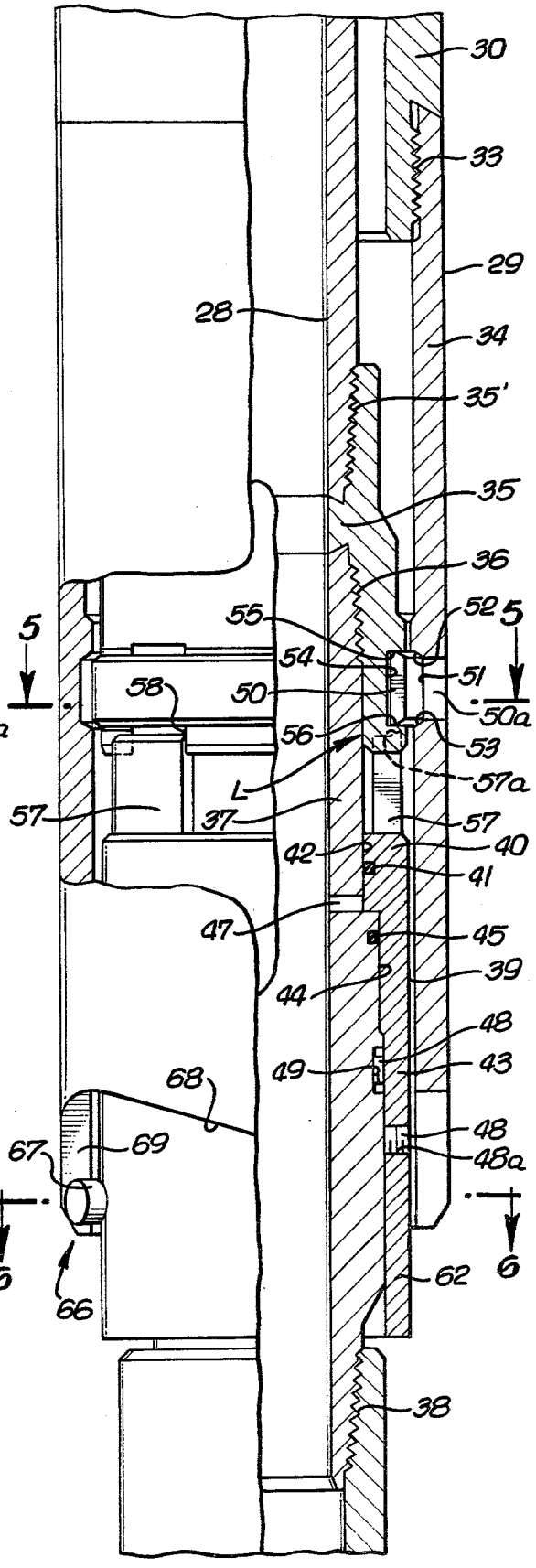
FIG. 3 is a view corresponding to FIG. 2 but showing the latch mechanism released.

Means are provided which prevent upward movement of the latch releasing piston 39, say in the event of a pressure reversal whereby tubing pressure in chamber 46 can overcome annulus pressure holding the piston in the position of FIG. 3. While separate holding means might be employed for this purpose, the illustrated form employs the latch ring 50 as an abutment engageable by the upper ends of the lugs 57 on the piston, when the latch ring is contracted into the groove 54. As shown, the upper and lower, outer edges of the latch ring 50 are bevelled and will be fully cammed into the groove 54 by the one of the bevelled shoulders 52 and 53, upon release by the piston lugs 57. This disposes the ring in the path of upward movement of the release piston lugs 57 for abutting engagement therewith. More specifically, the lugs 57 have downwardly and inwardly inclined surfaces **57*a* at their upper ends which can engage with the lower bevelled edge of the latch ring 50** and thereby, also, prevent undesired expansion of the ring.

If for any reason, the hydraulic release of the connector cannot be effected, but it is nevertheless desired to remove the running tubing from the slick joint, means are provided at 66 operable by rotation of the running tubing and the connector housing 34. Thus, a screw or other lug or pin 67 is provided on the piston 39 and projects radially outwardly. The outer connector housing 34 has an inclined or camming surface 68 extending downwardly and circumferentially from a longitudinal stop shoulder 69, whereby right hand rotation of the housing 34 will cam the piston downwardly.

In the use and running of the apparatus described above, the equipment is progressively made up in the tubular string structure as necessary and desired and progressively lowered in the well casing. In the case of the wireline tubing valve V, the valve unit is not installed in the seating nipple 10, but the control tubing 13 is lowered along with the upwardly extending tubing string from an appropriate reel and progressively secured to the tubing string, as the tubular structure is lowered in the casing and the well head equipment is set. At this time the fluid within the well bore can be displaced by the circulation of fluid downwardly through the tubing and upwardly through the tubing casing annulus. With the control tubing 13 closed off, the seating ball 27 can be dropped into the tubing string or circulated down the tubing to seat upon the displaceable ball seat 25. In the illustrated installation, the packer structure P is adapted to be set an an initial pressure. After the packer has been set, fluid pressure can be applied to displace the ball seat and pressurize the annulus below the packer to test the packer. During this test, the latch means L retains the sealing connector in the locked condition. Thereafter, pressure is increased in the annulus above the packer to activate the latch means L of the sealing receptacle S, thereby enabling the upper body structure 29 to telescope relative to the sealing mandrel or slick joint 28, so that reversals of compression or tension cannot be transmitted through the tubing structure. As the latch piston moves downwardly to release the latch ring 50 for inward contraction, fluid is displaced from the inner chamber 46 into the tubing. Since the piston 39 is latched down, as seen in FIG. 3, the piston cannot be later elevated by high pressure in the tubing. Prior to placing the well on production, the valve means V is run in and landed in the seating nipple 10 on a wireline tool, the latter then being retrieved and utilizing normal valve operating procedures, the valve means V is opened to allow the well to be placed on production.

Within the mandrel 28 of the tubing seal structure S is an internal groove **28*a* providing a downwardly facing shoulder 28*b*** adapted to be engaged and to retain in place the usual blanking plug, in the event that the upwardly extended tubing string and associated valve structure is to be pulled from the well.

From the foregoing it will now be apparent that the present invention provides a novel well bore apparatus, whereby the production packer can be lowered into a setting position in the well casing, set and anchored, the tubing seal hydraulically released, and the well placed on production, all without requiring rotative manipulation of the tubing string. However, if required, the running string can be released by rotation, through the cam lug 67 and cam surface 68.

I claim:

1. Well bore apparatus adapted to be installed in a well casing for conducting produced well fluid to the top of the well, comprising: a tubing string extending into the casing; packer means in said tubing string having normally retracted expansible casing engaging anchor means and resilient packing deformable into sealing engagement with the casing; and a releasable sealing connector in said tubing string above said packer means; said connector including a pair of telescopically interengaged inner and outer tubular sealing bodies; one of said bodies being connected with said packer means and the other of said bodies being connected with the upwardly extended tubing string; releasable latching means retaining said bodies in a telescopically contracted condition; fluid pressure responsive release means operable responsive to the pressure of fluid in the casing above said packer means to release said latching means enabling telescopic extension of said bodies; and means responsive to manipulation of said tubing string to release said latching means.

2. A releasable telescopic tubing seal structure for releasably connecting a well bore packer in a running string of tubing, comprising: a pair of telescopically engaged tubular members including an external receptacle and an inner sealing mandrel; said members having means connectable in a tubular string for disposition in said tubing string in a well bore; means sealingly and slidably engaged between said receptacle and sealing mandrel; normally released latch means releasably latching said receptacle and said sealing mandrel together; latch retaining means for said latch means including a fluid pressure responsive annular piston slidably disposed on said sealing mandrel; said sealing mandrel and said piston having different diameters in axially spaced relation providing a differential area subjected to the pressure of fluid externally of said sealing mandrel to move said piston in a direction to release said latch means.

3. A releasable telescopic seal structure as defined in claim 2; said external receptacle having sealing means slidably and sealingly engaged with said sealing mandrel.

4. A releasable telescopic seal structure as defined in claim 2; said latch means including a circumferentailly extended resilient ring; one of said receptacle and said sealing mandrel having a peripheral recess; said latch retaining piston having portions engageable with said ring in a first position retaining said ring in said recess and being shiftable by fluid pressure acting on said differential area to a second position releasing said ring for movement from said recess.

5. A releasable telescopic seal structure as defined in claim 2; said receptacle having an internal peripheral groove; said latch means including a resiliently contractible ring held in said groove by said latch retaining piston and normally contractible from said groove.

6. A releasable telescopic seal structure as defined in claim 2; said receptacle having an internal peripheral groove, said latch means including a resiliently contractible ring of partly circular form held in said groove by said latch retaining piston.

7. A releasable telescopic seal structure as defined in claim 2; said receptacle having an internal peripheral groove, said latch means including a resiliently contractible ring of partly circular form held in said groove by said latch retaining piston, said inner sealing mandrel and said latch retaining piston forming a piston chamber therebetween with another area of said piston facing oppositely to the differential area thereon, and passage means extending into said piston chamber from the interior of said sealing mandrel.

8. A releasable telescopic tubing seal structure comprising: a tubular outer body structure having an internal groove; a tubular inner body structure; resiliently contractible latch means carried by said inner body structure and having portions shiftable radially into and from said groove; said body structures having portions defining an annular space; an annular piston in said space; means defining between said body structures a piston chamber at one end of said piston; passage means extending from the interior of said inner body structure to said piston chamber to urge said piston to a first position; releasable means initially holding said piston in said first position; said piston having means engageable with said latch means and holding said latch means in said groove when said piston is in said first position; said piston having differential areas responsive to the pressure of fluid in said annular space to release said releasable means and shift said piston to a second position releasing said latch means enabling resilient contraction of said latch means from said groove.

9. A releasable telescopic tubing seal structure as defined in claim 8, including sealing means within said outer body structure slidably and sealingly engaged with said inner body structure.

10. A releasable telescopic tubing seal structure as defined in claim 8; including means for holding said piston in said second position upon movement of said piston to said second position.

11. A releasable telescopic tubing seal structure as defined in claim 8; including means for holding said piston in said second position upon movement of said piston to said second position including coengageable portions of said latch means and said piston.

12. A releasable telescopic tubing seal structure as defined in claim 8; including means for holding said piston in said second position upon movement of said piston to said second position including coengageable portions of said latch means and said piston, said coengageable portions having confronting surfaces for holding said latch means in said groove.

13. An oil well packer assembly for use on a tubing string, said packer assembly comprising; hydraulic pressure set packer means including well bore anchor means and elastomeric sealing means expansible into anchoring and sealing engagement with the wall of the well bore; a telescopic joint sealably and slidably attaching said packer means to the tubing string; latch means initially holding said joint telescopically contracted and releasably responsive to the pressure of fluid supplied to the well bore when said packer means is actuated into anchoring and sealing engagement with the well bore wall; and means responsive to the manipulation of said tubing string to release said latch means.

* * * * *